United States Patent [19]

Nishihara et al.

[11] 4,102,750

[45] Jul. 25, 1978

[54] PROCESS FOR PRODUCING FORMED COKE FOR METALLURGICAL USE

[75] Inventors: Nobuyoshi Nishihara; Toshiaki Okuhara; Tetu Nishi; Hiroyuki Nakama; Chikara Saito; Kouichi Yuta, all of Kitakyushu, Japan

[73] Assignee: Nippon Steel Corporation, Tokyo, Japan

[21] Appl. No.: 714,813

[22] Filed: Aug. 16, 1976

[30] Foreign Application Priority Data

Aug. 18, 1975 [JP] Japan ..... 50-99911

[51] Int. Cl.[2] ..... C10B 49/06; C10B 53/08; C10L 5/02

[52] U.S. Cl. ..... 201/6; 44/10 K; 201/23; 201/24; 201/34; 201/36; 201/44

[58] Field of Search ..... 201/6, 21, 23, 24, 32, 201/34, 36, 37, 44; 44/10 C, 10 K

[56] References Cited

U.S. PATENT DOCUMENTS

| | | | |
|---|---|---|---|
| 2,131,702 | 9/1938 | Berry | 201/6 |
| 3,140,985 | 7/1964 | Schmalfeld | 201/36 X |

*Primary Examiner*—Joseph Scovronek
*Attorney, Agent, or Firm*—Toren, McGeady and Stanger

[57] ABSTRACT

Process for producing formed coke for metallurgical use from coal powder by continuously heating with a high temperature gas as heating medium for carbonizing agglomerated coal which are made of coal powder and a binder such as coal tar, pitch and petroleum asphalt, comprising providing tuyeres for introducing gas at the middle and the lower parts of an upright type carbonization oven, adjusting temperature of the gas to be supplied to the tuyere at the middle part at 600° to 800° C, adjusting the supply rate of the gas so as to maintain the temperature of the gas on the agglomerated coal at 300° to 500° C, and further adjusting the supplied heat to the lower part of the carbonization oven including the lower tuyere to amount less than 50% of the total supplied heat.

1 Claim, 4 Drawing Figures

PROCESS FOR PRODUCING FORMED COKE FOR METALLURGICAL USE

FIELD OF THE INVENTION

The present invention relates to a process for producing formed coke for metallurgical use by carbonizing agglomerated coal of a lower caking property to which a binder, such as, coal tar, pitch and petroleum asphalt, has been added. The present process provides a method to economically produce formed coke on a commercial scale that satisfies the criteria for use in a large scale blast furnace by utilizing lower caking coal as much as possible.

BACKGROUND OF THE INVENTION

In the production of formed coke, the process in which coal is formed with an added binder has been established on a commercial scale, while a process where agglomerated coal is carbonized has not yet been successful on such a scale so as to be useful for the amounts and quality required for use in a large blast furnace. This is due to the difficulty in the production of high quality formed coke on an industrial scale without causing crushing, agglutinating and cracking of the agglomerated coal that might occur depending on the heating and loading conditions in the carbonization process.

The present invention provides an effective process for carbonizing agglomerated coal by which agglomerated coal retains its shape through the continuous carbonization process on an industrial scale and, at the same time, the caking property of the raw material coal is utilized to improve the strength of the formed coke.

The inventors of the present invention carried out detailed and systematic investigations to determine the effect of heating and mechanical loading on the behavior of the agglomerated coal during carbonization and also on the strength and other qualities of the formed coke by use of a so-called carbonization oven simulator in which the conditions of heating and mechanical loading can be arbitrarily chosen. As a result, the range of heating rate as shown in FIG. 1 as measured at the center of the agglomerates is desirable. These data provide useful information for determining the most favorable heating conditions to obtain the best quality of coke and the lowest cost of production considering all the possible phenomena involved in the carbonization oven on the industrial scale, as is evident from the foregoing experimental techniques.

In particular, the upper and the lower limits of the heating rate at which the temperature at the center of agglomerated coal is maintained between 200° and 400° C have been chosen for assuring the best conditions to improve the strength of the formed coke by keeping the velocity with which coal particles are softened and melted to each other, occurring from the surface towards the center of agglomerated coal, higher than a certain value. At the same time, unfavorable phenomena such as crushing, agglutinating and surface cracking of the agglomerated coal in the carbonization process are prevented.

These data are completely new and were discovered by the present inventors as a result of systematic investigations.

There has been a qualitative knowledge that, when agglomerated coal is heated in the temperature range above 400° C, cracking may be formed on the surface owing to re-solidification and shrinking of the agglomerates. This fact has been quantitatively established in the present invention. The method of carbonization involving the heating speed at a temperature close to the mentioned upper limit is desirable from the point of view of the efficiency of the equipment. The carbonization of the present invention has been accomplished based on the entirely new discoveries found from the investigation of the heating rates with which the temperature of the center of agglomerated coal is increased from 200° to 1000° C as shown in FIG. 1. The desirable heating rate in FIG. 1 depends naturally on the method of production, size, composition of raw materials and the initial temperature in the carbonization oven. However, the pattern of the curves as a whole and the basic principle remain unaltered.

Even if the entirely new pattern of heating (FIG. 1) is known, it remains still very difficult by the conventional techniques of carbonization of coal to apply the knowledge to the continuous carbonization on an industrial scale. It is evident to use, in the continuous carbonization of coal or agglomerated coal, an upright type, for example, a Lurgi, carbonization oven using a gas as heating medium. However, there exists no carbonization oven capable of satisfying the complicated heating rate characteristics as shown in FIG. 1.

Generally speaking, when complex characteristics are required for the heating rate, some carbonization ovens are employed in series to satisfy the need. But it is usually accompanied by technical problems such as handling of high temperature coal and sealing of high temperature gases. Some alternative methods have been proposed for adjusting the heating speed. Thus, a blow of cooling gas is applied to a part of the carbonization zone where a relatively slow heating speed is required, and a fraction of the heating gas is blown outside of the oven. However, this involves increased complexity in the installation, and prohibits an increased scale of the installation.

To solve these problems, the present inventors investigated the variation of thermal properties of agglomerated coal, such as, the specific heat and thermal conductivity during the carbonization process, and the heating treatment of the agglomerates with a gas as heating medium from the theoretical and experimental aspects. The present inventors have developed the new technic for the oven operation in accordance with the new pattern of heating. The features of the present invention lie in controlling both temperature and velocity of the flow of hot gas which are supplied to a tuyere at the middle and the lower parts of the carbonization zone in an upright type carbonization oven in such a way as to satisfy the experimental requirements as shown in FIG. 1.

DETAILED DESCRIPTION OF THE INVENTION

The present invention will be described in more details referring to the attached drawings.

DESCRIPTION OF THE PREFERRED EMBODIMENT

Figure 2:
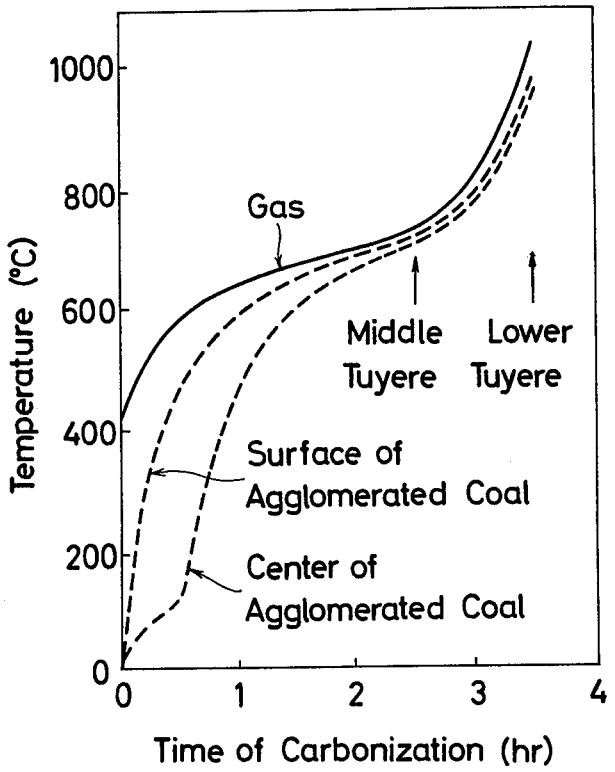
FIG. 2 shows the relation between the temperature and the time of carbonization.

FIG. 2 shows distribution of temperature of the gas and the agglomerated coal calculated for particular conditions in a carbonization oven equipped with double tuyeres. Selected conditions in FIG. 2 are as follows: volume of the agglomerated coal, 80 cc; the gas at the lower tuyere, temperature 1050° C, velocity 800 $Nm^3$/t-dry coal, the gas at the middle part tuyere, temperature 700° C, and velocity 2400 $Nm^3$/t-dry coal. A peculiar pattern of the temperature distribution is seen, forming an inflection point at the part corresponding to the tuyere at the middle part, which is considered to be due to the presence of the tuyere. The surface temperature of agglomerated coal, when introduced at the top of the carbonization oven, is rapidly raised close to the temperature of gas at the top of the oven, and as the agglomerations descend in the carbonization oven it approaches the temperature of gas. In the close vicinity of the tuyere at the middle part, the temperature is almost equal to that of the gas introduced through the tuyere. On the other hand, the temperature at the centers of the agglomerated coal rises much slower than that of the surface until the agglomerates are resolidified, because of the remarkably small thermal conductivity of 0.2 kcal/mh° C. The resolidification zone is passed at about 500° C, and then afterwards, the temperature at the centers approaches that of the surface, and they are almost equal at the tuyere at the middle part. Below the middle tuyere, the slope of curve increases again, meaning more rapid change in the gas temperature. However, the temperature of the agglomerated coal, of which the thermal conductivity has been increased to over 0.8 kcal/mh° C, easily follows that of the gas until it reaches the final carbonization temperature.

Figure 1:
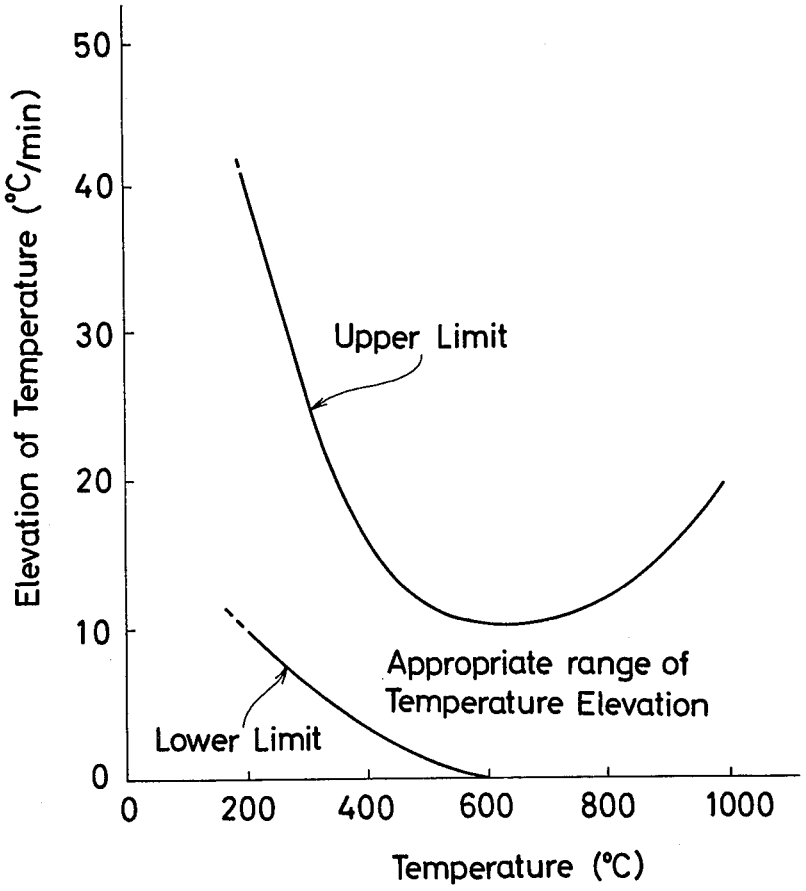
FIG. 1 is a graph showing the appropriate speed in elevation of temperature for carbonization according to the present invention.

The carbonization process using gas from double tuyeres is characterized by the easy formation of the gas temperature distribution pattern in the carbonization oven, corresponding to the favorable heating rate curve as shown in FIG. 1. In addition, the effect of the variables of this invention, that is temperature and amount (or velocity) of the gases supplied to the two tuyeres, on the temperature distribution of gas in the carbonization oven and on the heating speed curve at the centers of agglomerated coal will be explained referring to FIG. 3.

Figure 3:
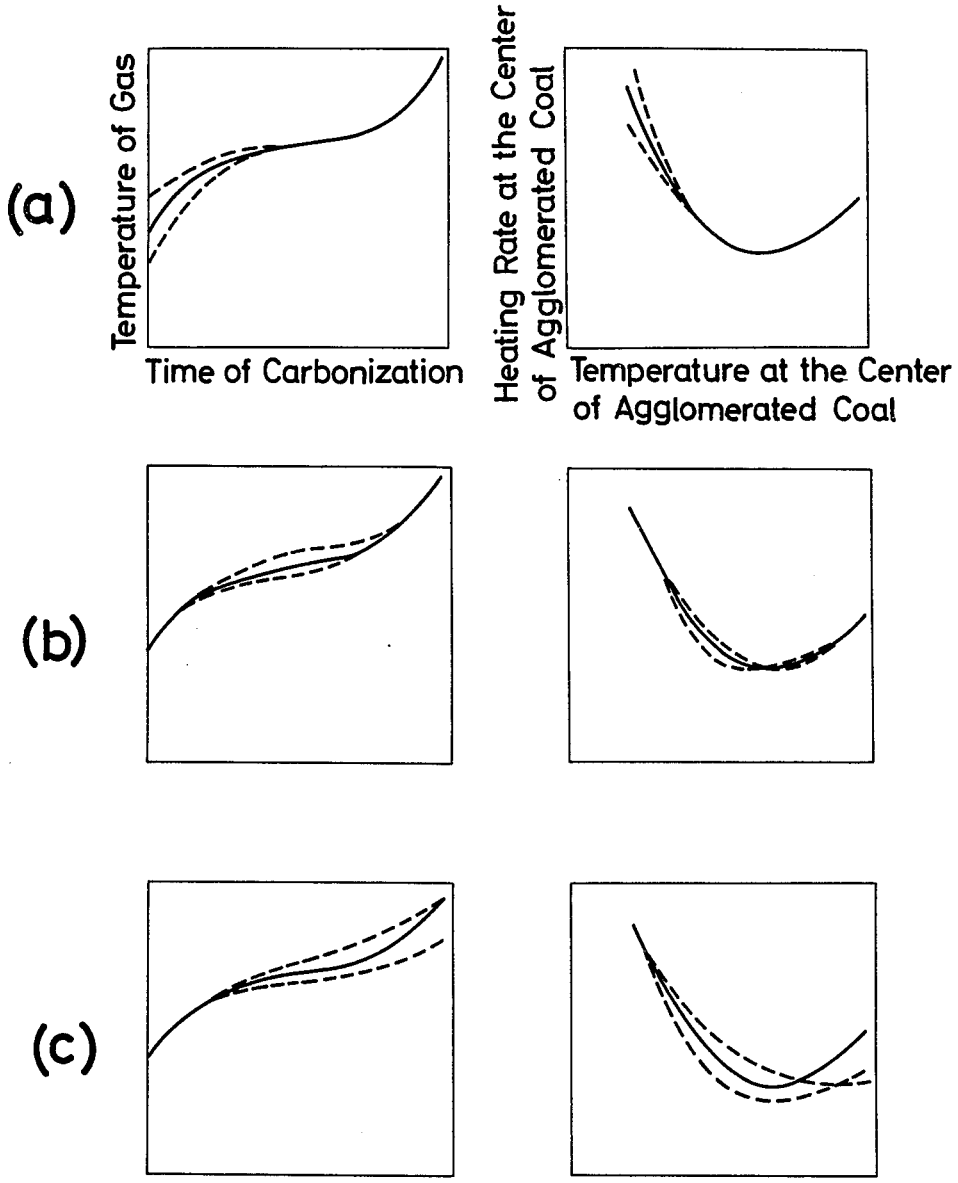
FIG. 3(*a, b, c*) shows the effect of temperature and supply rate of gases supplied to the tuyeres on the variation of temperature distribution in the carbonization oven and of the heating rate curve at the center of agglomerated coal.

FIG. 3(*a*) illustrates the effect observed when the amount of gas supplied to the tuyere at the middle part is varied. The variation of the gas temperature at the top of the carbonization oven chiefly influences the heating rate at the center of agglomerated coal from 200° to 400° C. FIG. 3(*b*) shows the effect when the heat energy of the gases supplied to each tuyere is kept constant while the temperature of gas supplied to the middle part is varied. In this case, variation of the temperature that corresponds to the inflection point of the gas temperature curve in the vicinity of the tuyere at the middle part induces a shift of the minimum point on the heating speed curve at the center of agglomerated coal, influencing the heating rate between 500° to 1000° C. FIG. 3(*c*) shows the results obtained when the ratio of heat energy of the gases supplied to the middle and the lower parts is varied while the total heat energy of the gases and the temperatures of the gases supplied to each tuyere are being kept constant. Results are that the favorable fundamental pattern of the heating rate curve can no longer be maintained if the ratio of heat energy of the gases exceeds a certain value.

As has been described above, the carbonization process with a gas using double tuyeres is suited to produce favorable heating rate curve as illustrated in FIG. 1. However, it is most important to appropriately select the temperature and the amount of gases supplied to each of the tuyeres. The present inventors have determined suitable ranges of the operative quantities on the basis of the theoretical analysis of conduction of heat as well as experimental efforts. A part of the experiment will be shown in the examples and reference examples which are set forth hereinafter.

The first of the requirements is that the amount of the gas supplied to the tuyere at the middle part should be adjusted so that the temperature of gas at the top of the carbonization oven be kept between 300° – 500° C, as explained in connection with FIG. 3(*a*). The range of temperature eventually corresponds to the temperature at which softening of coal commences and the temperature at which resolidification is completed, respectively. This is elucidated as follows. The lower limit values of the desirable heating rate curve between 200° and 400° C at the center of agglomerated coal in FIG. 1 substantially regulates the elevation of temperature inside the agglomerated coal when the coal becomes softened. Therefore, the lower limit of the gas temperature is considered to be equal to or higher than the softening temperature of coal. On the other hand, limitation of the temperature to prevent surface cracking which is due to the softening and resolidification at the surface of agglomerated coal that are accompanied by the volume change has decided the upper limit of the temperature. Presumably this temperature is eventually almost equal to the resolidification temperature.

The second requirement is that the temperature of the gas supplied to the tuyere at the middle part should be in the range from 600° to 800° C as shown in FIG. 3(*b*). As has been described in connection with FIG. 2, only a small difference exists between the temperatures of the gas and the briquet, so that the least heating speed is required, as exemplified in FIG. 1, to be in the range from 600° to 800° C of agglomerated coal. Therefore it is quite reasonable that this temperature range coincide with the most suitable range of temperature of the gas supplied to the tuyere at the middle part.

The third of the requirements is that the heat energy of the gas supplied to the lower tuyere should not exceed 50% of the total heat energy supplied to the carbonization zone, as explained in connection with FIG. 3(*c*). The value has been selected considering primarily the requirement that the heating rate at the centers of agglomerated coal in the temperature range 500° to 800° C does not exceed the upper limit.

As has been mentioned above, the present invention has been developed on the basis of the newly found correlation between the heating rate pattern in the carbonization process of agglomerated coal and the quality of formed coke product and the conditions which have been revealed to govern the heating rate. Thus the present invention is also epoch-making since ideal heating conditions are provided by this invention by employing a continuous carbonization process with a high temperature gas from two tuyeres which is considered most simplified with respect to the equipment and is most free from problems when extended into a larger scale.

Figure 4:
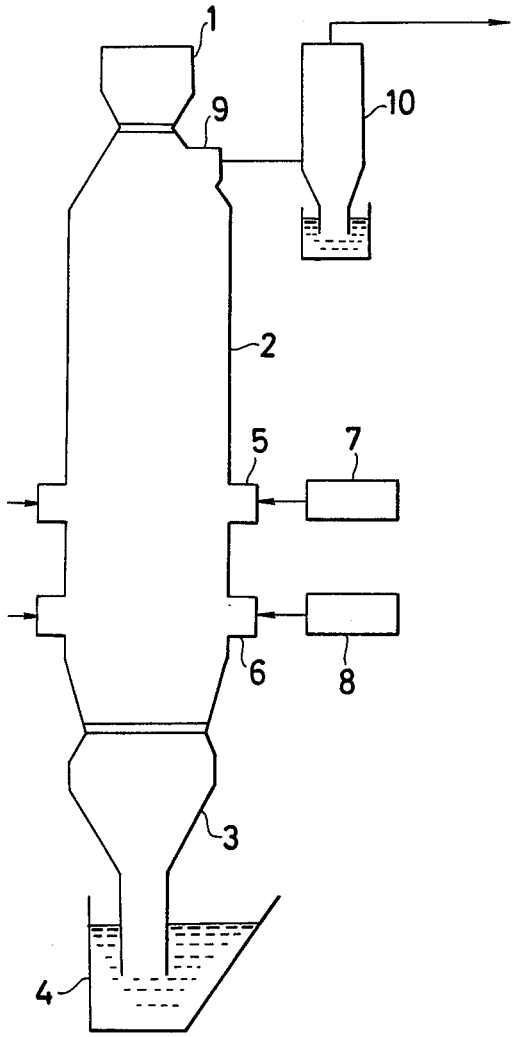
FIG. 4 shows an embodiment of the present invention.

An example of the apparatus employed in the process of this invention will be briefly explained with reference to FIG. 4. The main part consists of inlet chamber 1 for agglomerated coal, carbonization chamber 2, outlet for formed coke 3, and water bath 4. Tuyeres 5, 6 are provided respectively at the middle and the lower parts of the carbonization chamber 2. Gases controlled at the described temperatures for heating the agglomerated coal are introduced to the tuyeres from the high temperature gas generator 7, 8. As the agglomerated coal introduced in inlet 1 descends in the carbonization chamber, the agglomerates are heated by the hot gases from the tuyeres 5, 6 following the heating curve, an example of which is shown in FIG. 2, until they reach the final carbonization temperature, discharged from the outlet chamber 3 and cooled in the water bath 4. A mixture of gas consisting of the hot gases from 5, 6 and the gaseous product generated from the agglomerated coal during the carbonization process is discharged from the gas outlet 9 and the tar remover 10, for use as fuel in other processes.

Dimensions of the carbonization chamber are as follows: inner diameter, 0.8 m; distance between the inlet level and the tuyere at the middle, about 5 m; distance between the two tuyeres, about 2 m; production of formed coke, about 20 tons per day. This apparatus is of medium industrialized scale.

Naturally, the heat held by the high temperature coke when the carbonization process has completed may be used for preheating the supply gas to the carbonization oven, and the gas at the top of the carbonization oven may be circulatingly used for heating other gases. These measures should naturally be taken from the industrial standpoint, to reduce the cost, but they stand outside the scope of this invention and are not described in particular.

DESCRIPTION OF PREFERRED EMBODIMENT

In the following sections the present invention will be further explained in detail by use of examples and reference examples.

EXAMPLE 1

This is an example of producing formed coke for the metallurgical use by the process of high temperature carbonization carried out in an upright type continuous carbonization oven from non-caking coal and anthracite as the main constituents which are formed at a high pressure into briquets with 8% of coal tar and pitch.

Each briquet of coal had the approximate volume of 80 cc. apparent density about 1.3, and contained 6.0% water, 22.1% volatile matters and 9.4% ash. In the carbonization oven shown in FIG. 4, the briquets are supplied from the inlet chamber 1 continuously at a rate of 750 kg/hr, while a high temperature gas at 720° C is blown into the tuyere 5 at a rate of 2000 $Nm^3$/hr and a gas at 1100° C into the tuyere 6 at a rate 500 $Nm^3$/hr. The exhaust gas from the outlet 9 at the top of the oven showed the temperature 420° C.

The formed coke produced under the specified conditions had the following properties: apparent density, 1:22; porosity 35%; volatile matter 0.8% and ash content 12.7%. Test on the drum index resulted in $D_{15}^{150}$ 84.3%, and $D_{25}^{150}$ 80.0%. The quality of the formed coke thus produced satisfies the fundamental requirements for use for large scale blast furnace coke.

EXAMPLE 2

This is an example in which formed coke for the metallurgical use is produced from the coal briquets similar to those in Example 1 employing the same carbonization oven, except preheating the briquets to 250° C in a gas-heating type preheating furnace.

The preheated briquets are introduced into the carbonization oven at a rate of 800 kg/hr. Gas introduced into the tuyere 5 is 720° C and 1400 $Nm^3$/hr, and the gas introduced into the tuyere 6 is 1100° C and 500 $Nm^3$/hr. The temperature at the top of the oven is about 470° C.

Properties of the formed coke thus produced were almost the same as those in Example 1.

REFERENCE EXAMPLE 1

In this example, the same procedure is followed as in Example 1, except that a gas is blown into the tuyere 5 at a rate of 1300 $Nm^3$/hr instead of 2000 $Nm^3$/hr. Consequently the temperature of the gas at the top was as low as 280° C. Conspicuous difference in the properties of the formed coke from those in Example 1 is the drum index. Thus, $D_{15}^{150}$ 66.6% and $D_{25}^{150}$ 63.4% are obtained. The reason is assumed to be due to much lower heating rate at the range of 200° to 400° C at the center of the briquets than the desirable range of heating speed as illustrated in FIG. 1.

REFERENCE EXAMPLE 2

The same conditions as in Example 2 are observed, except that a gas is introduced in the tuyere 5 at a rate of 2300 $Nm^3$/hr instead of 1400 $Nm^3$/hr in Example 2. The temperature of the gas at the top of the oven is as high as 550° C. The drum index of the formed coke obtained is as follows: $D_{15}^{150}$ 82.7% and $D_{25}^{150}$ 52.6%. The former value is not much different from those in Examples 1 and 2, while the latter value is much smaller. This is assumedly due to a much higher rate of heating exceeding the desirable range corresponding to the center temperature of briquets at 200° - 500° C, which causes the briquets to form swelling followed by cracking.

REFERENCE EXAMPLE 3

The same conditions as in Example 1 are observed, except that a gas at a temperature of 820° C is blown into the tuyere 5 at a rate of 1700 $Nm^3$/hr. The temperature at the top of the oven is 450° C.

Drum index of the formed coke obtained is as follows: $D_{15}^{150}$ 81.0% and $D_{25}^{150}$ 66.5%. Low value of $D_{25}^{150}$ is conspicuous in comparison with those in Examples 1 and 2. This is assumedly due to higher heating rate over the upper limit of the desirable range corresponding to the temperature 500° - 700° C at the center of briquets, which caused the briquets to form cracking by heat.

REFERENCE EXAMPLE 4

In this example, the same conditions are followed as in Example 2, except that the rate of gas introduced from the tuyere 5 is reduced to 900 $Nm^3$/hr and the rate from the tuyere 6 is increased to 700 $Nm^3$/hr without changing the temperature of the gases. The drum index of the formed coke thus produced is $D_{15}^{150}$ 83.3% and $D_{25}^{150}$ 64.7%. The latter value is conspicuously small in comparison with those in Examples 1 and 2. This is assumedly due to the higher heating rate over the desirable upper limit which corresponds to the temperature of the center of briquets 600° – 800° C. Probably, heating too fast causes the briquets to form cracking by heat.

In the above examples and reference examples, the strength which is one of the most important properties of formed coke for the metallurgical use is expressed by the drum index, so as to illustrate the importance of the desirable heating rate of this invention when applied to the coal briquets. It has been described that the condition of heating that satisfies the requirement on the desirable range of temperature can be realized with an upright type continuous oven having double tuyeres by adjusting both the temperature and the flow rate of the gases introduced in the tuyeres within appropriate ranges, and that the severe restriction is laid on the ranges.

The present inventors have investigated also the composition of raw materials and on the size of briquets. The experiments were carried out with a composition of 20 – 35% volatile matter to obtain a strength in the formed coke at least equal to that of conventional blast furnace cokes. The size of briquets employed was 27 – 112 cc in volume.

Although the range of desirable heating rate depends slightly on the composition and size of briquets, the essential of this invention remains unchanged, and therefore the temperatures of the gases in any part and the rate of flow of the gases at the tuyeres, as described in the claims of this invention, fulfill the requirements.

What is claimed is:

1. In a process for producing formed coke for metallurgical use wherein agglomerated coal is carbonized by passing it downwardly through an upright carbonizing oven while continuously heating the agglomerated coal with high temperature gases supplied through tuyeres provided at the middle and bottom parts of the carbonizing oven, said agglomerated coal being made from coal powders and binders, the improvement which comprises:

(a) adjusting the temperature of the gas supplied through the tuyeres at the middle part of the carbonizing oven to a temperature between 600° and 800° C;

(b) adjusting the supply rate of the gas supplied through the tuyeres at the middle part of the carbonizing oven so as to maintain the temperature of the gas leaving the top part of the carbonizing oven in the range between 300° and 500° C;

(c) regulating the gas supplied through the tuyeres at the bottom part of the carbonizing oven so that the heat supplied therefrom is less than 50 percent of the total heat supplied to the carbonizing oven; and (d) controlling the temperature and feed rate of the heating gas such that the rate of temperature elevation of the agglomerated coal as it passes through the oven is within the upper and lower limit ranges of FIG. 1.

* * * * *